US008740583B2

(12) United States Patent
Pollack et al.

(10) Patent No.: US 8,740,583 B2
(45) Date of Patent: Jun. 3, 2014

(54) OCEAN ENERGY CONVERSION

(75) Inventors: Jack Pollack, Houston, TX (US); Hein Wille, Eze (FR)

(73) Assignee: Single Buoy Moorings, Inc., Marly (CH)

( * ) Notice: Subject to any disclaimer, the term of this patent is extended or adjusted under 35 U.S.C. 154(b) by 924 days.

(21) Appl. No.: 12/824,041

(22) Filed: Jun. 25, 2010

(65) Prior Publication Data

US 2011/0067768 A1 Mar. 24, 2011

Related U.S. Application Data

(60) Provisional application No. 61/245,128, filed on Sep. 23, 2009.

(51) Int. Cl.
*F04D 13/08* (2006.01)
*F04D 29/60* (2006.01)
*F04D 29/64* (2006.01)

(52) U.S. Cl.
USPC ..... 417/360; 417/423.3; 417/423.14; 60/641.7

(58) Field of Classification Search
USPC ..... 417/360, 361, 423.3, 423.14, 423.15; 137/565.17, 565.37; 60/641.7
See application file for complete search history.

(56) References Cited

U.S. PATENT DOCUMENTS 3,093,269 A * 6/1963 Messer ..... 222/333
3,112,049 A * 11/1963 Messer ..... 222/333
3,369,715 A * 2/1968 Carter ..... 222/333
3,890,065 A * 6/1975 Eller et al. ..... 417/360
4,080,106 A * 3/1978 Haesloop ..... 417/53
4,116,009 A 9/1978 Daubin
4,174,791 A * 11/1979 Auchter et al. ..... 222/333
4,281,614 A 8/1981 McNary et al.
4,350,014 A 9/1982 Sanchez et al.
4,435,132 A * 3/1984 Haesloop et al. ..... 417/360
4,497,342 A * 2/1985 Wenzel et al. ..... 137/565.17
5,865,605 A * 2/1999 Weidlein ..... 417/360
7,311,055 B2 12/2007 Peereboom et al.
2008/0131208 A1 6/2008 Bull
2009/0178722 A1 7/2009 Howard
2009/0179425 A1 7/2009 Van Drentham Susman et al.

OTHER PUBLICATIONS

International Search Report dated Sep. 2, 2010 received for corresponding PCT patent application No. PCT/US2010/041867.

* cited by examiner

*Primary Examiner* — Peter J Bertheaud
(74) *Attorney, Agent, or Firm* — Wong, Cabello, Lutsch, Rutherford & Brucculeri, LLP.

(57) ABSTRACT

A system wherein cold water from near the sea floor is pumped through a primarily vertical pipe (12) to a body (14) floating at the sea surface so energy can be obtained from water temperature differences. A pump (50) located at the bottom of the pipe, is part of a pump module (46) that can be inserted and removed horizontally through a slot (44) in a bottom structure (22) lying at the bottom of the pipe. The top of the pipe is sealed to a movable pipe connector, by a U-shaped elastomeric seal (110). The pipe can include a short top pipe section (126) and a long bottom pipe section (127) of smaller diameter (D), whose upper portion can be pulled up through the top pipe section when the top pipe section is damaged.

5 Claims, 5 Drawing Sheets

OCEAN ENERGY CONVERSION

CROSS REFERENCE

Applicant claims priority from U.S. provisional patent application Ser. No. 61/245,128 filed Sep. 23, 2009.

BACKGROUND OF THE INVENTION

A variety of systems have been proposed to bring cold water up from a sea depth on the order of magnitude 1000 meters, to a body that floats at the sea surface. The difference in temperatures between the cold water and warmer water at the sea surface can be used to obtain energy. A pump for pumping water through a very long vertical cold water pipe can be mounted at the top of the pipe, but such a pump sucks water and creates a negative pressure in the pipe, which can require pipe reinforcement as with multiple rings. U.S. Pat. Nos. 4,497,342 and 7,311,055 show a pump at the bottom of the pipe, but this can make installation and repair of the pump difficult, and can make it difficult to extend an electrical cable to the pump.

When the cold water pipe is to be installed, its top can be pulled up against a pipe connector that is mounted on the floating body. The pipe connector should be able to move (especially to pivot slightly) to align itself with the top of the pipe. A seal should be provided around the movable pipe connector that provides a water tight seal when the pipe connector has been raised and slightly pivoted to its final position.

The cold water pipe is preferably of fabric to minimize cost. An upper portion of the pipe may be subjected to wave action, which can damage the pipe. It would be desirable if a damaged upper pipe portion could be replaced without the need to install another entire pipe.

SUMMARY OF THE INVENTION

In accordance with one embodiment of the invention, an ocean energy conversion system is provided for pumping cold water to flow up from a great depth in the sea, with the depth being on the order of magnitude of 1000 meters, to a body at the sea surface, where energy can be obtained from water temperature differences. The system includes a pump at the bottom of a long possibly fabric pipe which pumps up water and thereby creates a positive pressure in the pipe, in a construction that facilitates installation and removal of the pump. A bottom structure attached to a lower end of the pipe, has a horizontal installation slot through which a pump module can be moved horizontally to a final position in the bottom structure or through which the pump module can be removed for repairs. The bottom structure includes a ballast sleeve that contains ballast, and which forms a vertical structure passage through which water can flow. The pump module includes a module sleeve that has a module passage aligned with the structure passage, and with an electric motor and blades lying in the module sleeve.

The body at the sea surface includes a pipe coupling assembly which is connectable to a top of the pipe during installation. The pipe coupling assembly includes a stationary portion that is fixed to the body and a movable pipe connector that is vertically movable and is slightly pivotable and that connects to the pipe top. The movable pipe connector is sealed to the movable pipe connector by a seal of U-shaped cross section.

The pipe includes a top pipe section (no more than 20% of total pipe length) which is subjected to wave action and is most likely to be damaged, and a bottom pipe section that extends from the bottom of the top pipe section to the bottom of the entire pipe. The bottom pipe section is constructed with a slightly smaller outside diameter than the inside diameter of the top pipe section. As a result, when a tear or other damage occurs in the top pipe section, the lower pipe section can be pulled up through the upper pipe section to replace the upper pipe section.

The novel features of the invention are set forth with particularity in the appended claims. The invention will be best understood from the following description when read in conjunction with the accompanying drawings.

DESCRIPTION OF THE PREFERRED EMBODIMENTS

Figure 1:
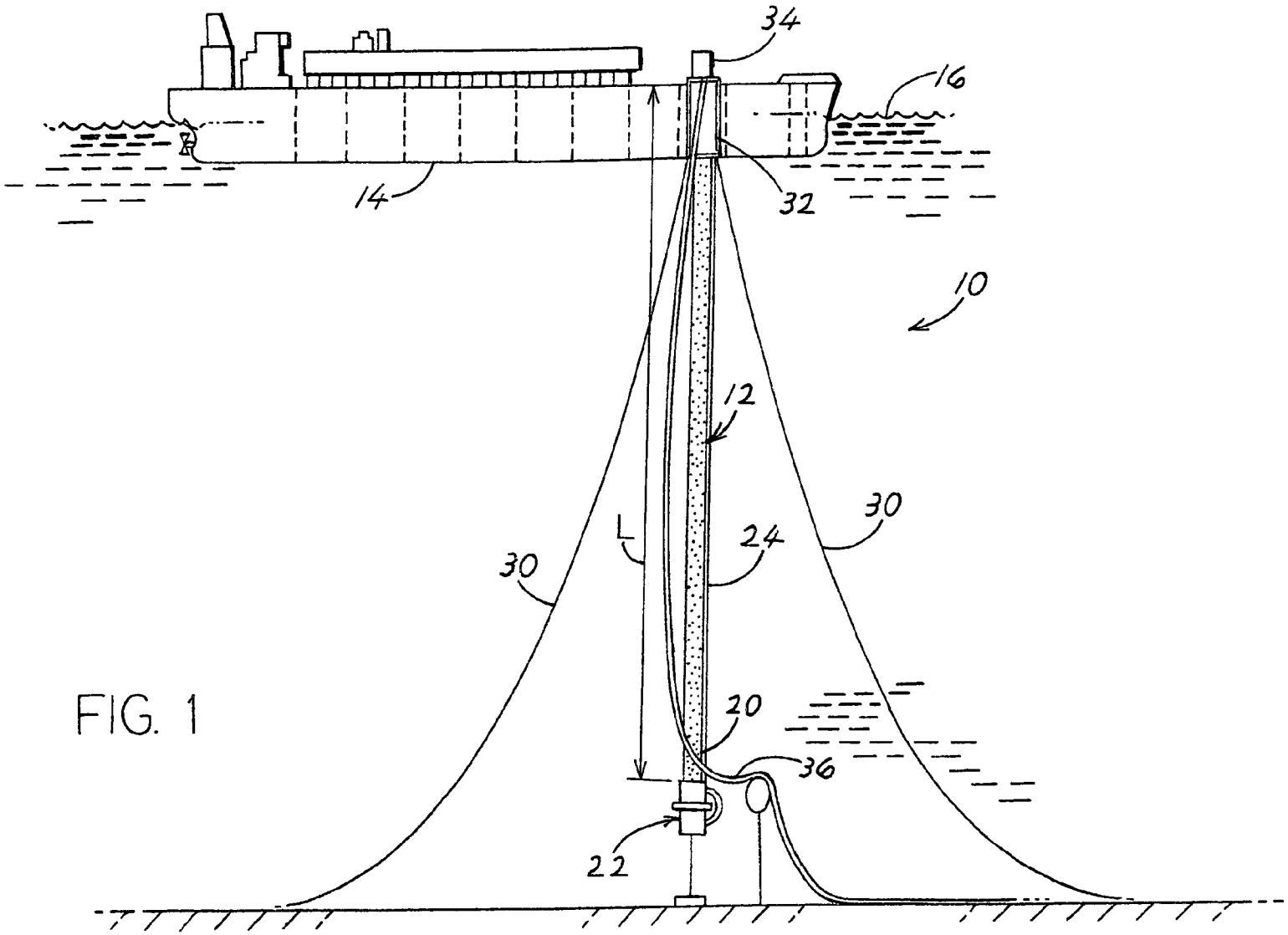
FIG. 1 is a side elevation view of an ocean energy conversion system of the present invention which includes a cold water pipe of the present invention extending down from a weathervaning vessel.

FIG. 1 illustrates an ocean energy conversion system 10 wherein a cold water pipe 12 hangs from a vessel or other body 14 that floats at the surface 16 of the sea. The length L of the pipe is on the order of magnitude of 1000 meters, so the lower end 20 of the pipe lies about 1000 meters below the sea surface where the sea water is much colder than at the sea surface. A typical diameter for such a pipe is four meters. It is well known to use the difference in temperatures of water from two sources to generate electricity. Applicant pumps water through the pipe by locating a pump in a bottom structure 22 at the lower end of the pipe and providing an electric cable 24 for energizing the pump. This creates a slightly greater pressure in the pipe than in the surrounding sea, which enables a low cost pipe to be used. The pipe is preferably made of synthetic fiber woven fabrics that may be combined by bonding, coating, vulcanizing, etc. to plastics, rubbers, etc., to form a flexible pipe.

In the system of FIG. 1, the floating body 14 is moored by chains 30 that are attached to the bottom of a turret 32. An electricity-passing swivel 34 connects to an electricity-carrying line 36. The top of the cold water pipe 12 is mounted on the turret to avoid interference with other parts that hang from the turret.

Figure 1A:
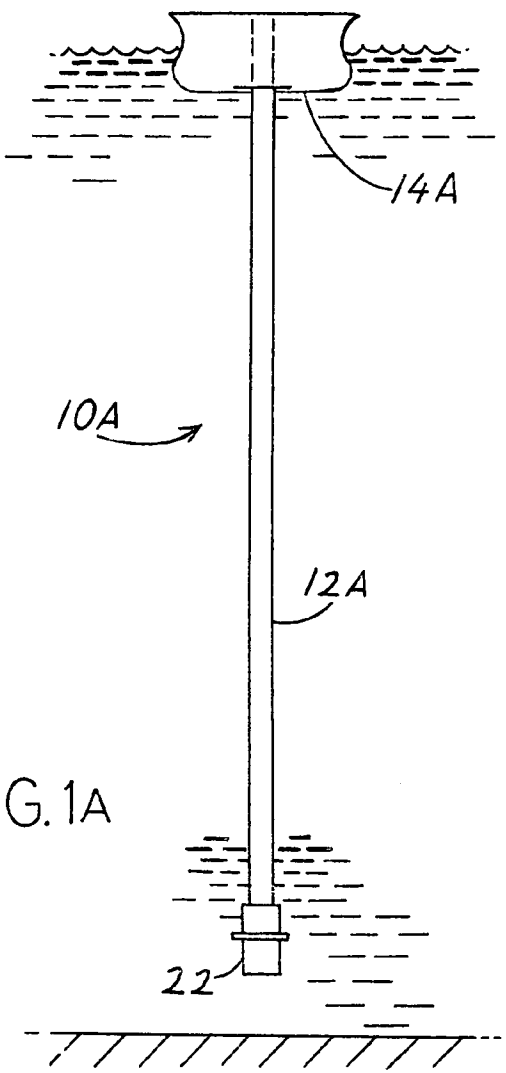
FIG. 1A is a side elevation view of another construction wherein the vessel does not weathervane.

FIG. 1A shows another system 10A wherein the body 14A at the sea surface is not a weathervaning vessel so the top of the pipe 12A is not mounted on a turret on the body.

Figure 2:
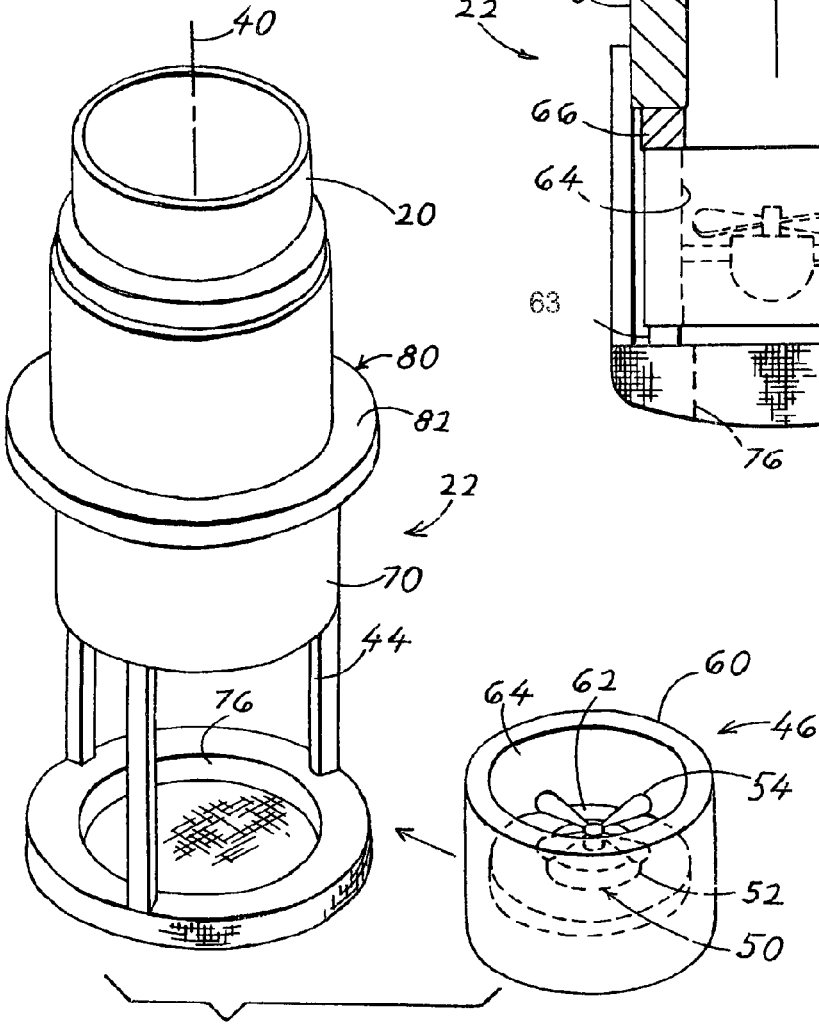
FIG. 2 is a top isometric view of a bottom structure attached to the bottom of the pipe of FIG. 1, with the pump module not yet installed.
Figure 3:
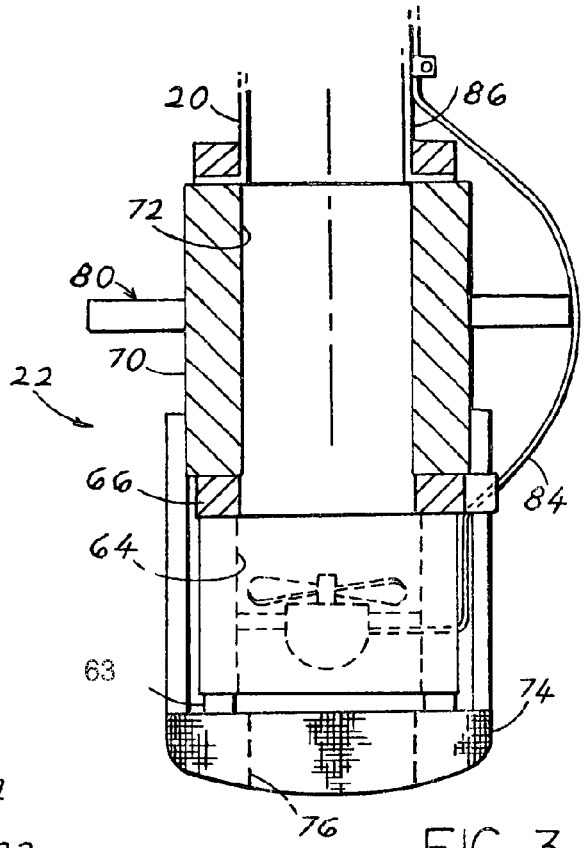
FIG. 3 is a sectional side view of the bottom structure of FIG. 2, with the pump module installed therein.

FIGS. 2 and 3 show the pipe axis 40 and show that the bottom structure 22 lies on the pipe axis and is attached to the bottom 20 of the pipe. The bottom structure has a horizontally-opening slot 44. A pump module 46 can be inserted horizontally through the slot to install the pump module and can be retracted horizontally to remove it for repairs. The pump module includes a pump 50 that can pump water up through the pipe, and that includes an electric motor 52 and a pump mechanism 54 such as blades. The pump module also includes a module sleeve 60 and a mounting plate 62 that mounts the pump on the module sleeve. The module sleeve has a vertical through passage 76.

The pump module can be inserted through the slot 44 as by a ROV (remote operated vehicle). Then, jacks 63 on the module can be operated to push up the pump module against a plate 66 that lies under a ballast sleeve 70 of the bottom structure to trap the pump module between plates 66, 74. The ballast sleeve 70 contains ballast, which resists upward movement of the pipe lower end. The ballast sleeve has a ballast sleeve passage 72 that is aligned with the module sleeve passage 64 and with the lower end 20 of the pipe. An inlet plate 74 extends across the bottom of the bottom structure and has a screen-covered opening 76 aligned with the passages of the module sleeve and ballast sleeve, so water can flow up to the pipe in a straight line.

Applicant adds at least one heave damping plate 80 to the bottom structure. The damping plate adds weight and adds water resistance to vertical movement to resist heave of the pipe lower end. The plate lengthens the natural period of vertical oscillation of the pipe. Each vertical water facing surface 82 of the plate preferably has at least 50% of the area within the pipe.

Electrical power for energizing the pump and operating the jacks is obtained through an electrical cable 84. The cable extends along the outside 86 of the pipe, which facilitates cable installation and repair.

Figure 5:
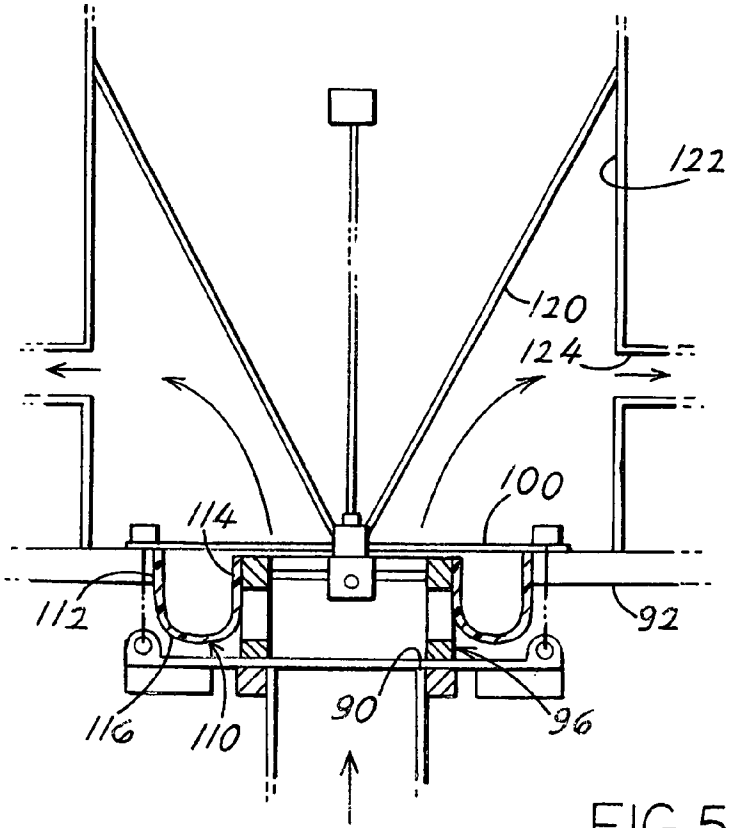
FIG. 5 is a view similar to that of FIG. 4, showing the pipe fully installed.
Figure 4:
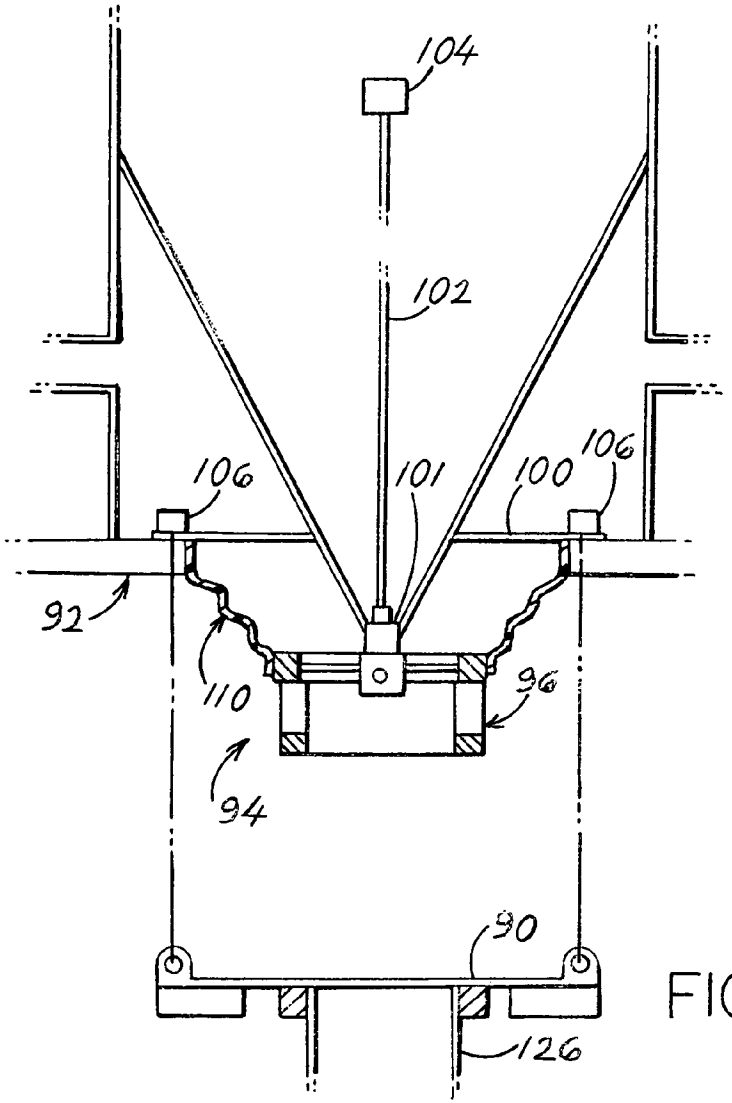
FIG. 4 is a sectional view of the upper end of the pipe of FIG. 1 during pipe installation, as the pipe top is being raised and approaches a pipe connector.

FIGS. 4 and 5 illustrate how the pipe top 90 is mounted to a stationary portion 92 of a pipe coupling assembly 94. The stationary portion 92 is the turret 32 in the system of FIG. 1 and is the entire barge body in the case of the system of FIG. 1A. The stationary portion 92 is stationary in that it does not move with respect to the floating body (or with respect to a turret on the body). A pipe connector 96 is provided that can connect to the pipe top 90 and that can be moved up to a mounting plate 100 on the stationary pipe portion. Initially, the pipe connector 96 is in the position shown in FIG. 4, where it is supported on a pivot support 101 by a cable or other line 102 of a pipe coupling winch 104. The pipe top 90 is supported by one or more pipe winches 106 that raise the pipe top until it abuts the pipe connector 96. The winches 106 are operated to raise the pipe top 90 and pipe coupling 96 to the position of FIG. 5 where the pipe coupling abuts the mounting plate 100 and the pipe connector 96 is fixed to the mounting plate. During upward movement of the pipe top 90, it and the pipe connector may undergo pivoting as well as upward movement. A water tight seal is required that will seal the pipe coupling to the stationary pipe coupling portion 92 during vertical movement of the pipe coupling as well as during slight pivoting of it and the pipe top.

FIGS. 4 and 5 show an elastomeric seal 110 that has a U shape in the fully installed pipe position of FIG. 5, and that can be distorted to allow one end to move down and pivot as in FIG. 4. In the undistorted shape of FIG. 5, the seal has a radially outer vertical wall 112 and a radially inner vertical wall 114, with the vertical walls connected by a curved connection wall 116. A conical directing wall 120 has a lower end fixed to the pipe connector 96 and has upper ends that slide vertically in a tube 122 that has outlets 124.

Figure 1B:
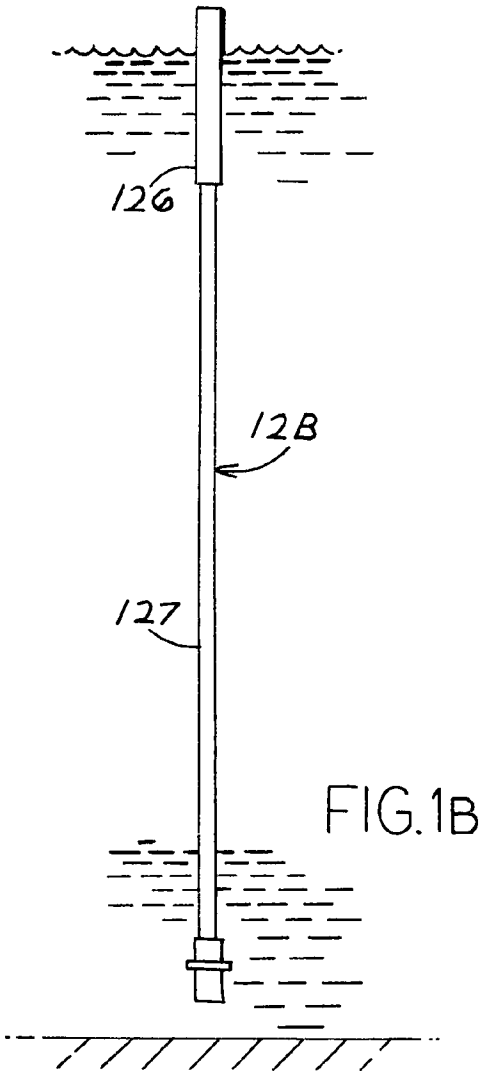
FIG. 1B is a side elevation view of another construction of a cold water pipe.

The cold water pipe can be constructed as shown in FIG. 1B, with the pipe 12B having a top pipe section 126 that extends through the ocean wave zone and with the pipe having a lower pipe section 127 that constitutes most of the total pipe length of about 1000 meters. The top pipe section 126 has a length no more than 20% of the total pipe length. The top pipe section lies in the wave zone, and is the section that is most subject to damage from repeated movements of the floating body. In the event of damage to the top pipe section, applicant can avoid the need to replace the pipe or repair it, by raising the lower pipe section 127 up through the top pipe section 126. The top pipe section is replaced in function, but remains in place.

Figure 6:
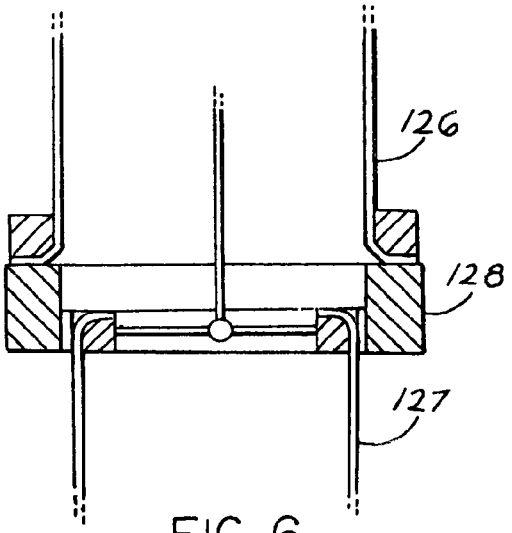
FIG. 6 is a sectional view showing the area of connection of the lower end of a top pipe section of FIG. 1A to the upper end of a major lower pipe section.
Figure 8:
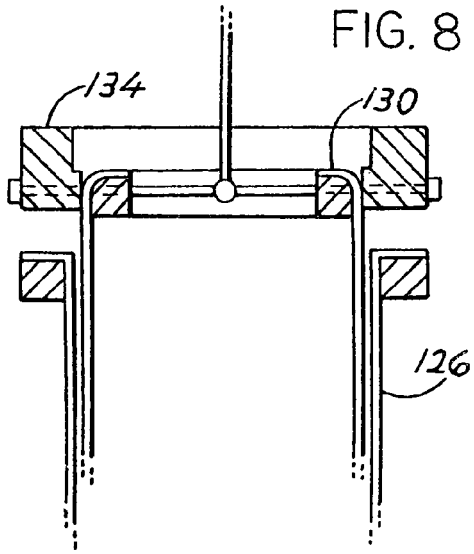
FIG. 8 is a sectional view of the upper end portion of the pipe, showing the upper end of the major lower pipe section emerging from the top of the top pipe section.
Figure 7:
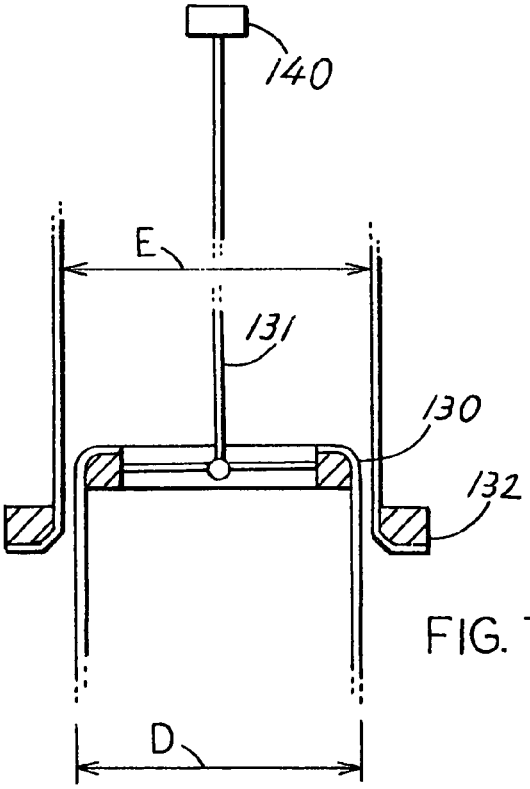
FIG. 7 is a view similar to that of FIG. 6, but after the disconnection of the two pipe sections and the beginning of raising the lower pipe section.
Figure 9:
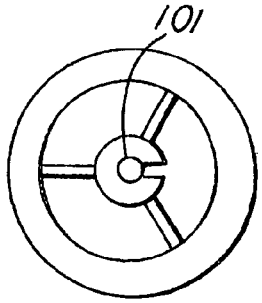
FIG. 9 is an end view of a spider coupling of FIG. 6.

FIG. 6 shows the intersection where the top pipe section 126 is connected through a connecting ring 128 to the lower pipe section 127. If the top pipe section is damaged, the pipe section ends 130, 132 are disconnected as shown in FIG. 7 and a cable or other tension transmitting member 130 is pulled up by a winch 140 to raise the top of the top pipe section. The lower pipe section has a smaller outside diameter D than the top pipe section inside diameter E, so the lower pipe section can move upward through the top pipe section until the upper end of the lower pipe section is connected to a pipe connector similar to the pipe connector 96 of FIG. 4. FIG. 8 shows the top 130 of the lower pipe section 127 lying above the top of the top pipe section 126 and being connected to a pipe connector 134.

Thus, the invention provides a cold water pipe with a pump at the bottom of the pipe, which is constructed to facilitate the installation and removal of the pump. A bottom structure is attached to the lower end of the pipe, the bottom structure having a horizontally-extending slot. The pump is part of a pump module that can move horizontally through the slot in the bottom structure to lie directly under the lower end of the pipe and to be aligned with the pipe. The bottom structure comprises a ballast sleeve that contains ballast and that has a passage aligned with the pipe. The pump module is in the form of a sleeve with a passage aligned with the ballast sleeve passage. The bottom structure has an inlet plate at its bottom that forms an opening aligned with the sleeves. An elastomeric seal of U-shape cross section is used to seal a movable pipe connector to a stationary pipe coupling portion. A cold water pipe can be constructed with a lower pipe section that extends along most of the pipe length and that has a smaller outside diameter than the inside of a top pipe section. If the top pipe section is damaged, the lower pipe section can be pulled upward through the top pipe section to essentially replace the top pipe section.

Although particular embodiments of the invention have been described and illustrated herein, it is recognized that modifications and variations may readily occur to those skilled in the art, and consequently, it is intended that the claims be interpreted to cover such modifications and equivalents.

What is claimed is:

1. An ocean energy conversion system which includes a body (14) lying at the sea surface, a cold water pipe (12, 12A, 12B) that has a primarily vertical pipe axis and that extends down from said body toward the sea floor and that has a pipe lower end (20) lying at a depth on the order of magnitude of 1000 meters under the sea surface, and a pump module with an electrically energized pump with said pump module (46) mounted on said pipe lower end, and with said pump module having a pump mechanism that pumps sea water upward through the pipe, including;

a bottom structure (22) attached to said pipe lower end. said bottom structure having an axis that is coincident with said pipe axis, said bottom structure forming an installation slot (44) open orthogonally to the bottom structure axis through which said pump module can be installed and removed;

an electrical cable (84) extending upward from said pump module to said body; and, at least one heave damping plate (80) extending around said bottom structure (22) and having a larger diameter than an outside diameter of said bottom structure and having primarily vertically-facing surfaces (82) that each have at least 50% of the cross-sectional area within said pipe.

2. The system described in claim 1 wherein:

said bottom structure includes a ballast in the form of a structure sleeve (70) with sleeve structure walls that contain ballast material and with a structure sleeve passage (72) that is aligned with the bottom of said pipe;

said pump module includes a module sleeve (60) forming a module sleeve passage (64) that is aligned with said structure sleeve passage;

said bottom structure has a lower end forming an opening (76) that is aligned with said structure and module sleeve passages.

3. The system described in claim 1 wherein:

said installation slot opens primarily horizontally, and said electrical cable extends along the outside of said pipe.

4. The system described in claim 1 wherein:

said installation slot opens primarily horizontally, said bottom structure has plates (66, 74) lying respectively above and below said slot, and said pump module has means (63) for trapping said pump module between said plates.

5. A method for installing a pump module (46) that has an electrically energized pump (50), on the lower end of a cold water pipe (12) which has been lowered to lie deep under a sea surface, so the pump can pump sea water upward through the pipe, comprising:

forming a lower end of the cold water pipe so it has a bottom structure (22) that forms a horizontally-opening slot (44);

separately lowering said pump module to the level of said slot while said pump module is connected to an electrical cable (84);

inserting said pump module into said slot and operating electrically energized devices (65) that latch the pump module in place in said slot;

passing electricity through said cable and said pump module to energize said pump.

* * * * *

UNITED STATES PATENT AND TRADEMARK OFFICE

CERTIFICATE OF CORRECTION

PATENT NO. : 8,740,583 B2
APPLICATION NO. : 12/824041
DATED : June 3, 2014
INVENTOR(S) : Jack Pollack and Hein Wille It is certified that error appears in the above-identified patent and that said Letters Patent is hereby corrected as shown below:

In the Claims

Column 5, line 6, in claim 1, delete "end." and insert --end,--

Signed and Sealed this
Twelfth Day of August, 2014

Michelle K. Lee

Michelle K. Lee
*Deputy Director of the United States Patent and Trademark Office*